US010981219B1

(12) United States Patent
Kamiyama et al.

(10) Patent No.: US 10,981,219 B1
(45) Date of Patent: Apr. 20, 2021

(54) CASTING MOLD AND MANUFACTURING METHOD OF CAST PART

(71) Applicant: Marelli Corporation, Saitama (JP)

(72) Inventors: Naohisa Kamiyama, Saitama (JP); Tetsuzo Nishimura, Ueda (JP); Makoto Murakami, Ueda (JP); Ikuo Kataoka, Ueda (JP); Shinya Sato, Ueda (JP); Takaaki Ikari, Tokyo (JP)

(73) Assignee: Marelli Cabin Comfort Japan Corporation, Saitama (JP)

( * ) Notice: Subject to any disclaimer, the term of this patent is extended or adjusted under 35 U.S.C. 154(b) by 0 days.

(21) Appl. No.: 16/634,456

(22) PCT Filed: Jul. 25, 2018

(86) PCT No.: PCT/JP2018/027978

§ 371 (c)(1),
(2) Date: Jan. 27, 2020

(87) PCT Pub. No.: WO2019/022165

PCT Pub. Date: Jan. 31, 2019

(30) Foreign Application Priority Data

Jul. 28, 2017 (JP) ..... JP2017-146977

(51) Int. Cl.

| | |
|---|---|
| ***B22D 19/00*** | (2006.01) |
| ***B22D 17/22*** | (2006.01) |
| ***B22C 9/08*** | (2006.01) |
| ***B22D 17/24*** | (2006.01) |

(52) U.S. Cl.
CPC ..... *B22D 17/24* (2013.01); *B22C 9/08* (2013.01); *B22D 17/22* (2013.01); *B22D 19/00* (2013.01); *B22D 19/0063* (2013.01)

(58) Field of Classification Search
CPC .... B22D 19/00; B22D 19/0063; B22D 17/22; B22C 9/06; B22C 9/08
See application file for complete search history.

(56) References Cited

U.S. PATENT DOCUMENTS 4,066,115 A * 1/1978 Ohtani ..... B22D 19/0063 164/333
2018/0252432 A1 9/2018 Ogasawara et al.

FOREIGN PATENT DOCUMENTS

| | | | | |
|---|---|---|---|---|
| JP | S47-30053 U | | 12/1972 | |
| JP | H07-290226 A | | 11/1995 | |
| JP | H11-198215 A | | 7/1999 | |
| JP | 2000-254768 A | | 9/2000 | |
| JP | 2002090077 A | * | 3/2002 | |
| JP | 2017-053615 A | | 3/2017 | |
| WO | WO-2006001951 A2 | * | 1/2006 | ..... B29C 48/832 |

* cited by examiner

*Primary Examiner* — Kevin E Yoon
(74) *Attorney, Agent, or Firm* — Young Basile Hanlon & MacFarlane, P.C.

(57) ABSTRACT

The casting mold is provided with: the molding wall portion forming the internal space; the supporting portion supports the heater to the molding wall portion; and the filling port allows the molten metal to flow into the internal space. The heater has: the end portion (the fixed portion) supported by supporting portion; and the extending portion extended from the end portion. The internal space has: the supporting region accommodating the end portion; and the extending region accommodating the extending portion. The filling ports respectively open to the portions of the molding wall portion facing the supporting regions.

6 Claims, 8 Drawing Sheets

CASTING MOLD AND MANUFACTURING METHOD OF CAST PART

CROSS-REFERENCE TO RELATED APPLICATION

The present application claims priority to Japanese Patent Application No. 2017-146977 filed on Jul. 28, 2017, the entire disclosure of which is incorporated herein by reference.

TECHNICAL FIELD

The present invention relates to a casting mold for molding a cast part and a manufacturing method of the cast part.

BACKGROUND

JP47-30053U discloses a heat exchanger in which a spiral pipe, through which fluid flows, and a heat generating sheathed heater are cast into a cast part.

In the manufacture of this type of heat exchanger, structures such as the pipe and the sheathed heater are installed in a casting mold, before a molten metal is filled into the casting mold. The molten metal thus filled is solidified to form the cast part. The cast part taken out from the casting mold includes built-in pipe and sheathed heater.

SUMMARY

However, when the above-mentioned cast part is formed by, for example, a die casting method, there is a risk in that, as the molten metal injected into the casting mold at high speed hits the structure, the structure such as the pipe, etc. may be deformed.

An object of the present invention is to prevent deformation of a structure cast into a cast part.

According to an aspect of the present invention, there is provided a casting mold for molding a cast part by filling molten metal into an internal space in which a structure is installed, the casting mold including: a molding wall portion forming the internal space; and a supporting portion supports the structure to the molding wall portion, wherein the structure has: a fixed portion supported by the supporting portion; and an extending portion extended from the fixed portion, the internal space has: a supporting region accommodating the fixed portion; and an extending region accommodating the extending portion, and a filling port opens to a portion of the molding wall portion facing the supporting region and the filling port allows the molten metal to flow into the supporting region.

In addition, according to an aspect of the present invention, there is provided a manufacturing method of a cast part for molding the cast part by filling molten metal into an internal space of a casting mold in which a structure is installed, wherein the casting mold is provided with: a molding wall portion forming the internal space; a supporting portion supports the structure to the molding wall portion; and a filling port configured to allow the molten metal to flow into the internal space, the structure has: a fixed portion supported by the casting mold; and an extending portion extended from the fixed portion, the internal space has: a supporting region accommodating the fixed portion; and an extending region accommodating the extending portion, and the manufacturing method including: an installation process of installing the structure in the casting mold; and a filling step of allowing the molten metal to flow into the internal space through the filling port, the filling port being configured to open to a portion of the molding wall portion facing the supporting region.

According to the above-described aspect, the molten metal filled into the casting mold flows into the supporting region from the filling port and hits the fixed portion of the intervening structure in the supporting region. In the fixed portion of the structure, a distance between the supporting portion and a portion at which the molten metal flow injected from the filling port hits is short, and therefore, a strength against the load applied by the high-speed molten metal flow is ensured. On the other hand, although the extending portion of the structure is separated away from the supporting portion of the casting mold, the molten metal flow has been decelerated by flowing into the supporting region from the filling port before hitting the extending portion, and therefore, the strength against the load applied by the molten metal flow is ensured. Thus, it is possible to prevent deformation of the structure.

DETAILED DESCRIPTION

Figure 1:
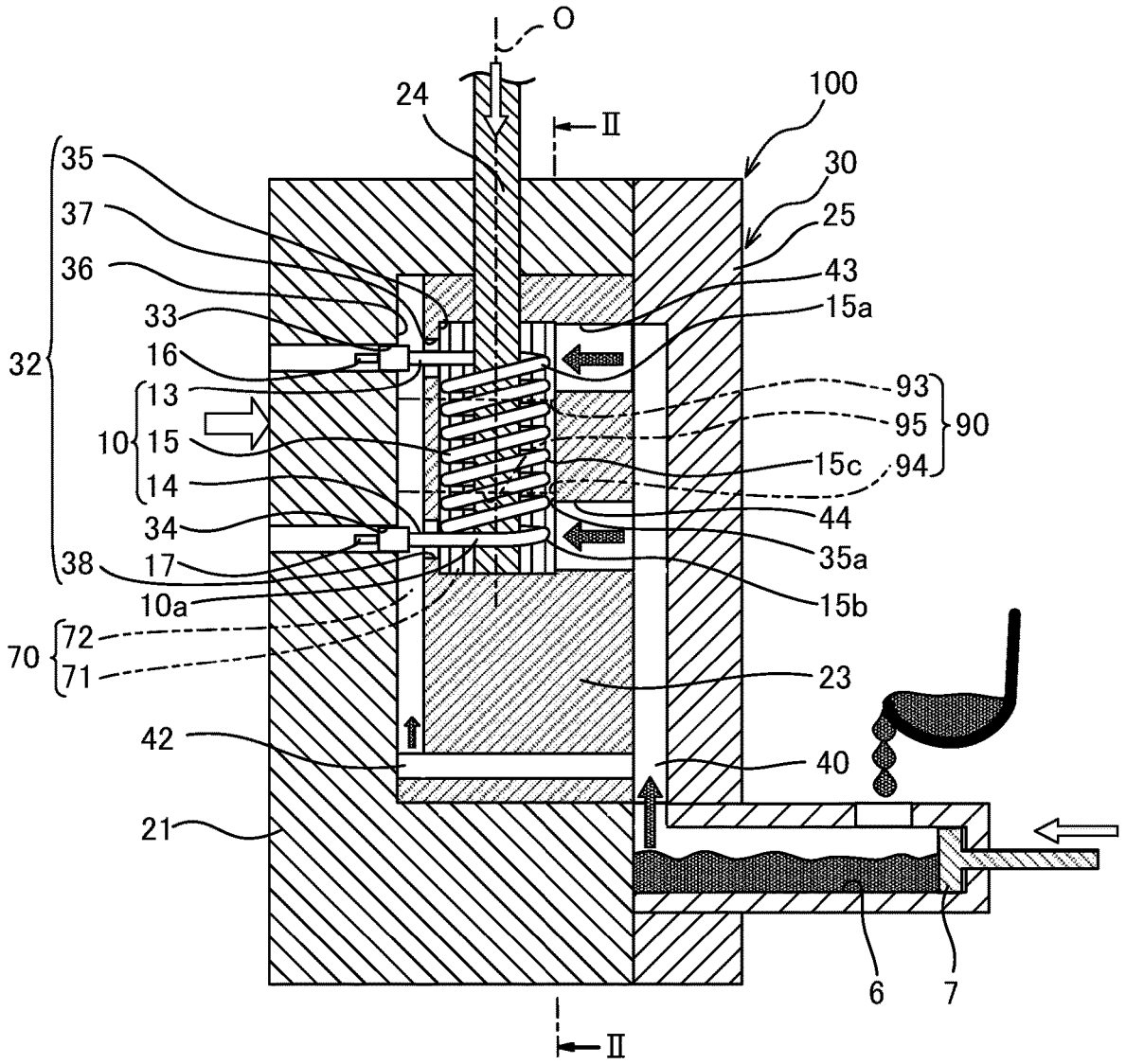
FIG. 1 is a vertical cross-sectional view showing a casting mold according to an embodiment of the present invention.

Embodiments of the present invention will be described below with reference to the attached drawings.

FIGS. 1 to 4 are cross-sectional views showing a casting device 100 to which a casting mold 30 according to the present embodiment is applied. For simplification of the description, a part of the casting device 100 is omitted in the drawing.

The casting device 100 for the die casting method is provided with a pressurizing part (piston) 7 for pressurizing a molten metal injected into an injection chamber 6 and the casting mold 30 forming an internal space 90 that is filled with the molten metal discharged from the injection chamber 6 by the pressurizing part 7. The molten metal is obtained by melting a metal such as an aluminum alloy, for example. As will be described later, in the mold 30, a cast part 70 is molded as the molten metal filled in the internal space 90 is solidified.

The casting mold 30 is provided with a fixed mold 25, and a movable mold 21, lateral slides 22 and 23, and a core 24 that are removed after molding. In the casting mold 30, the internal space 90 is formed as the movable mold 21, the lateral slides 22 and 23, and the core 24 are moved in the direction indicated by an outline arrow with respect to the fixed mold 25 and are held at predetermined positions.

In the internal space 90 of the casting mold 30, a heater 10 is installed as a structure to be cast into the cast part 70.

The heater 10 is a sheathed heater provided with a heat generating portion (not shown), which generates heat by energization, and a metal pipe (pipe) 10*a* for accommodating the heat generating portion. The heater 10 is not limited thereto, and may also be, for example, a PTC (Positive Temperature Coefficient) heater.

The heater 10 has end portions 13 and 14 serving as fixed portions supported by the casting mold 30 and a spiral extending portion 15 that extends from the end portions 13 and 14. Terminals 16 and 17 to which electrical wirings are connected are respectively provided at the distal ends of the end portions 13 and 14.

Figure 2:
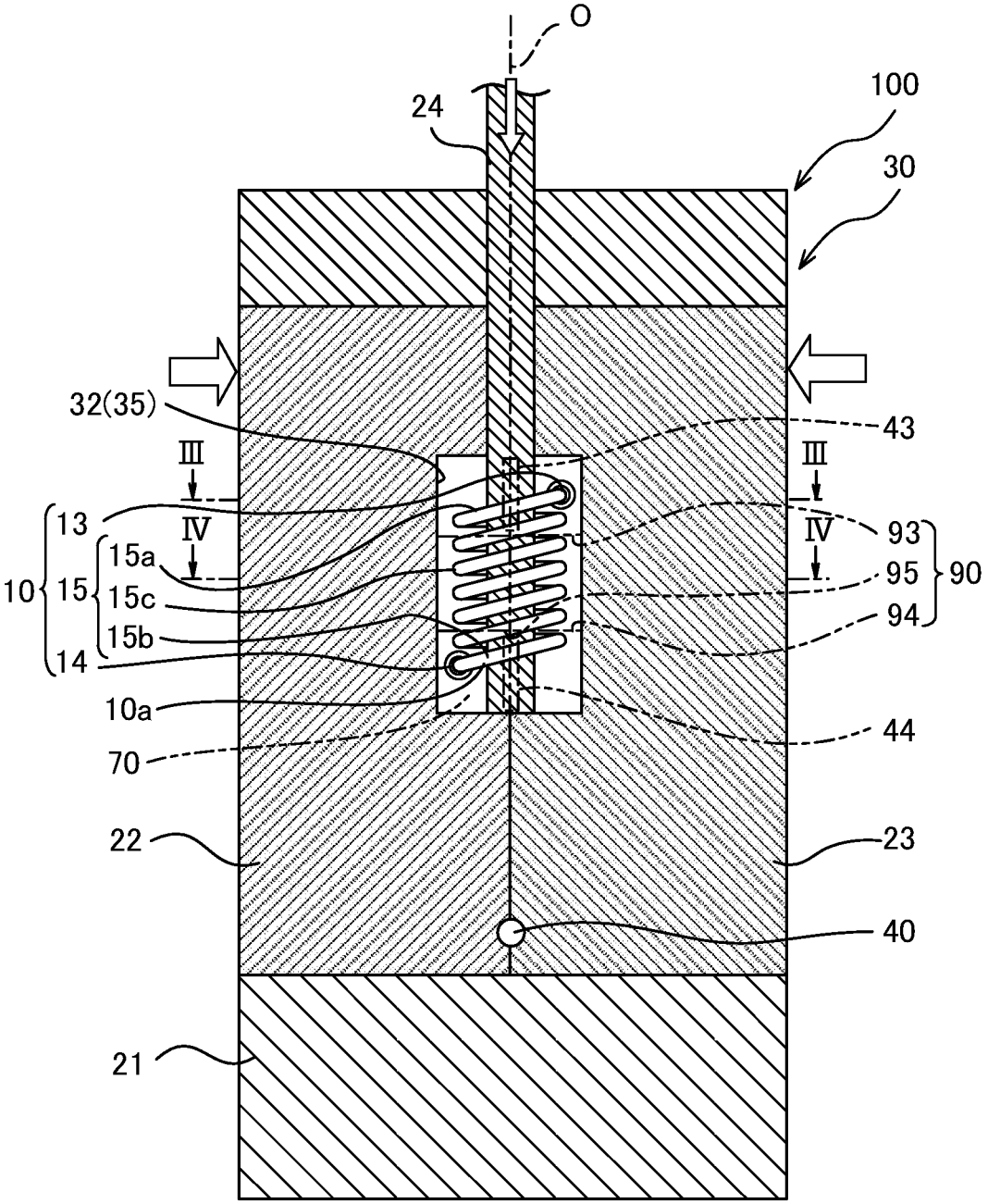
FIG. 2 is a longitudinal cross-sectional view taken along a line II-II in FIG. 1.
Figure 3:
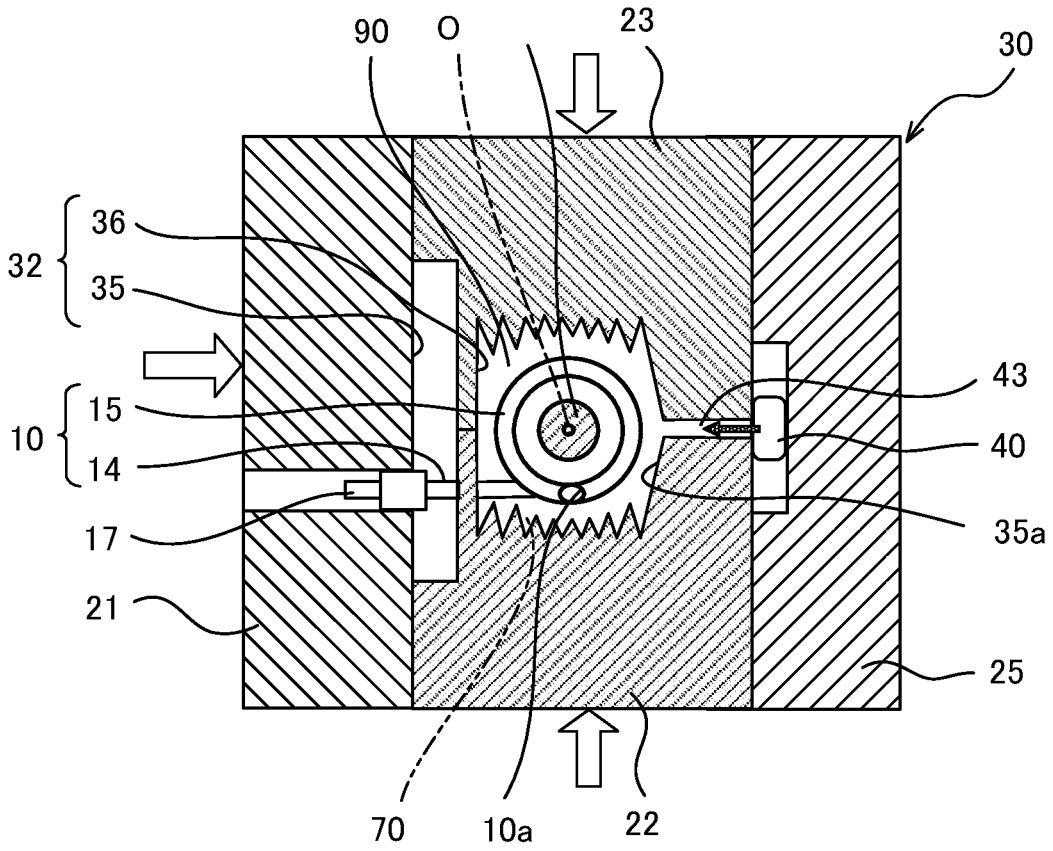
FIG. 3 is a lateral cross-sectional view taken along a line III-III in FIG. 2.
Figure 4:
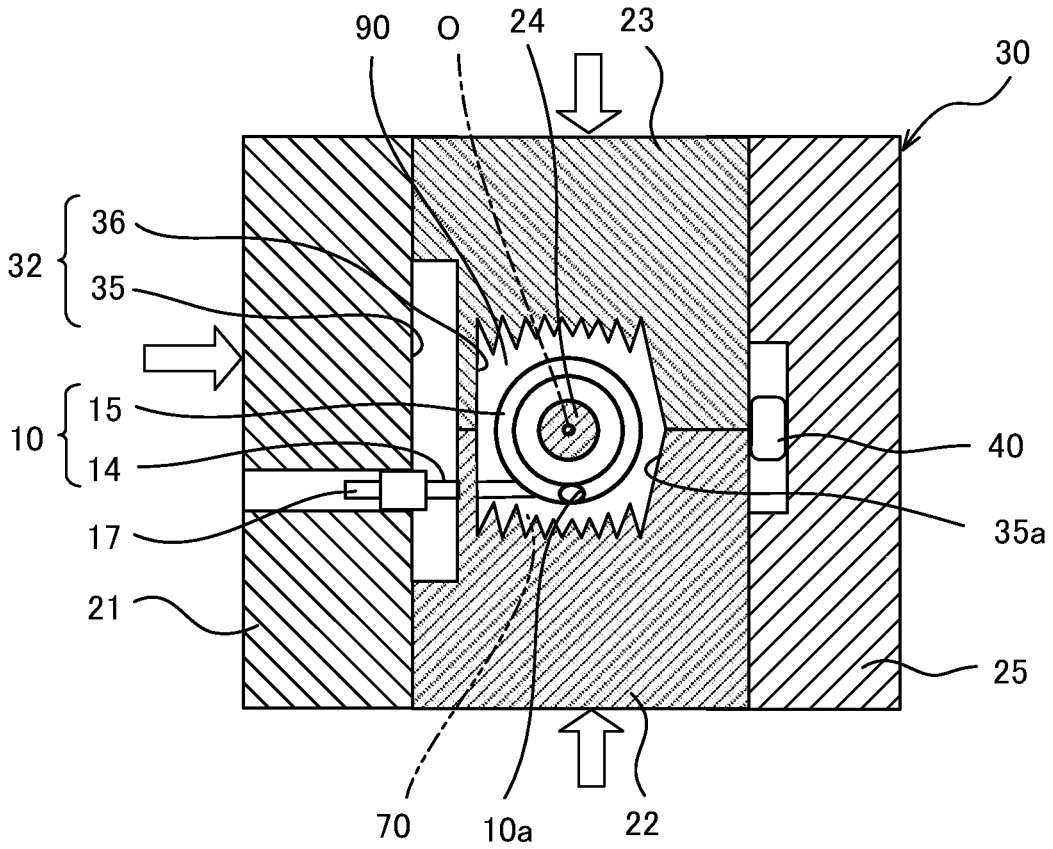
FIG. 4 is a lateral cross-sectional view taken along a line IV-IV in FIG. 2.

In the extending portion 15, the metal pipe 10*a* is spirally wound about the center line O. As shown in FIGS. 1 and 2, the metal pipe 10*a* is wound in the center line O direction such that gaps are formed. As shown in FIG. 3, the metal pipe 10*a* is wound in a substantially circular ring shape when viewed from the center line O direction. In this configuration, the shape of the extending portion 15 is not limited to that in which the metal pipe 10*a* is spirally wound, and the extending portion 15 may has, for example, a shape in which the metal pipe 10*a* extends in zigzag in the cast part 70.

The two end portions 13 and 14 extend substantially in parallel with each other from both ends of the extending portion 15. As shown in FIG. 1, the end portions 13 and 14 are formed so as to be substantially perpendicular with respect to the center line O. As shown in FIG. 2, the end portions 13 and 14 are respectively located in the vicinities of two opposing corner portions in the internal space 90.

The cast part 70 has a cylindrical shaped cylinder portion 71, into which the extending portion 15 is cast, and a plate-like lid portion 72, into which the end portions 13 and 14 are cast. The cylinder portion 71 and the lid portion 72 are integrally formed. The cylinder portion 71 has a plurality of fins that protrude out from its outer surface. It should be noted that the cast part 70 may not have the lid portion 72, and may have a single block shape into which the extending portion 15 and the end portions 13 and 14 are cast.

The casting mold 30 has a molding wall portion 32 for molding the cast part 70 and hole-shaped supporting portions 33 and 34 for supporting the end portions 13 and 14 of the heater 10 to the molding wall portion 32.

The molding wall portion 32 has a wall portion 35 for molding the cylinder portion 71, a wall portion 36 for molding the lid portion 72, and hole-shaped wall portions 37 and 38 for molding portions connecting the cylinder portion 71 and the lid portion 72.

The casting mold 30 has filling ports 42 to 44 that open to the internal space 90 and a runner 40 through which the injection chamber 6 is communicated with the internal space 90 through the filling ports 42 to 44.

The filling port 42 facing a lower portion of the internal space 90 opens to a lower end surface of the wall portion 36. The lid portion 72 of the cast part 70 is formed by the molten metal that is filled into the internal space 90 in the wall portion 36 from the filling port 42.

The filling ports 43 and 44 facing a side portion of the internal space 90 open to a side end surface 35*a* of the wall portion 35. The cylinder portion 71 of the cast part 70 is formed by the molten metal filled into the internal space 90 in the wall portion 35 from the filling ports 43 and 44.

Next, a process of casting the cast part 70 by the casting device 100 will be described.

First, an installation process of installing the heater 10 in the internal space 90 of the casting mold 30 is performed. In this installation process, the heater 10 is first assembled to the movable mold 21. At this time, the end portions 13 and 14 of the heater 10 are inserted into the hole-shaped supporting portions 33 and 34 through the hole-shaped wall portions 37 and 38, and thereby, the heater 10 is installed at a predetermined position in the internal space 90. Subsequently, the movable mold 21, the lateral slides 22 and 23, and the core 24 are set to the fixed mold 25, so as the internal space 90 to be formed.

Next, a filling step of filling the internal space 90 with the molten metal is performed. In this filling step, the internal space 90 is first filled with an active gas (oxygen). Next, the high-temperature molten metal is injected into the injection chamber 6, and the pressurizing part 7 is driven to pressurize the molten metal. As a result, the molten metal pushed out from the injection chamber 6 flows into the internal space 90 from the filling ports 42 to 44 through the runners 40, as indicated by arrows in FIG. 1. At this time, the molten metal is injected into the internal space 90 as a high-speed spray from the filling ports 42 to 44. As a result, in the internal space 90, a vacuum state is formed as the active gas is combined with the molten metal, and thereby, the molten metal is filled completely without forming a hollow space. Thus, formation of a cavity in the cast part 70 is prevented. It should be noted that the present invention is not limited to this, and for example, a gas vent hole may be formed in the casting mold 30 such that the air in the internal space 90 is discharged to the outside as the internal space 90 is filled with the molten metal.

Thereafter, in the casting mold 30, the molten metal filled in the internal space 90 is solidified to form the cast part 70. The movable mold 21, the lateral slides 22 and 23, and the core 24 are then separated from the cast part 70, so as the cast part 70 removed from the fixed mold 25.

As described above, the cast part 70 is manufactured. The cast part 70 with the built-in heater 10 is assembled to a tank (not shown) as a heater unit. In the heater unit, the heat generated by the heater 10 is transferred to a fluid (medium) circulating in the tank via the cast part 70 so as to heat the fluid.

Next, the arrangement of the heater 10 and the filling ports 43 and 44 with respect to the internal space 90 in the casting mold 30 will be described.

Figure 5:
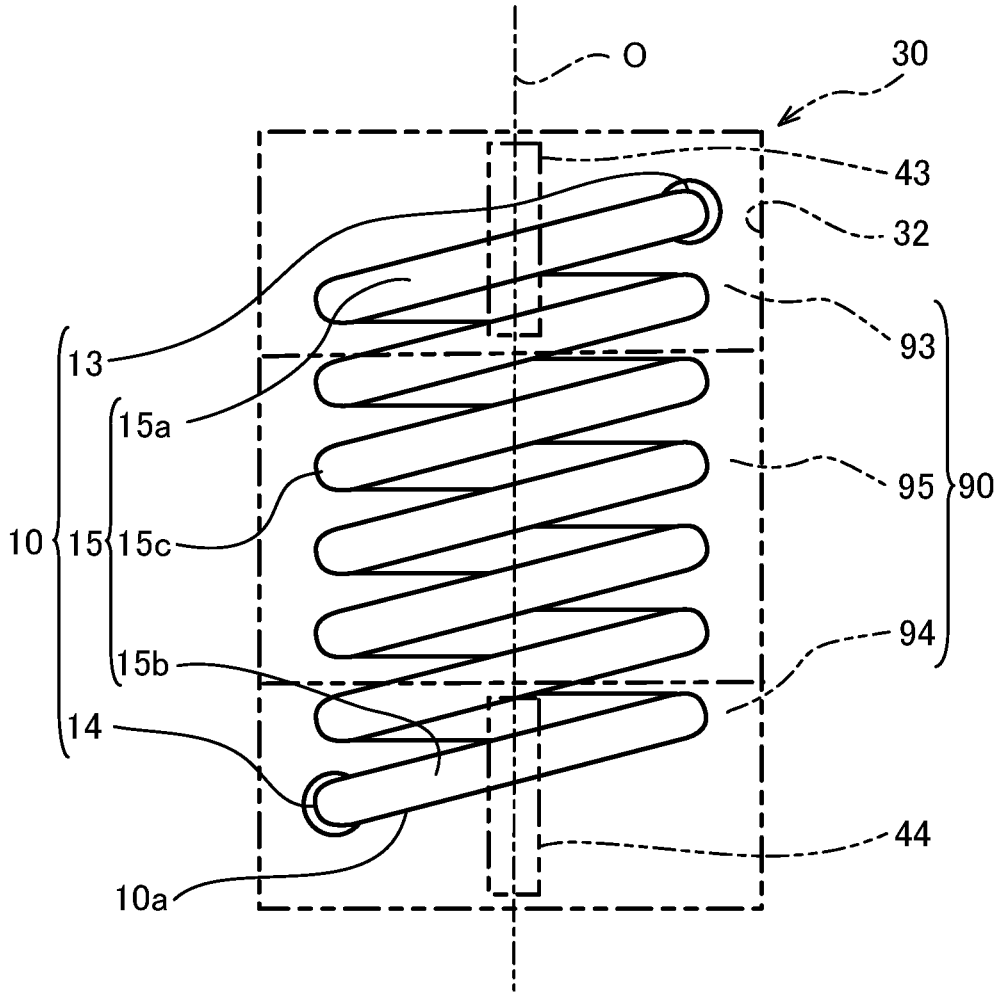
FIG. 5 is a diagram showing an arrangement of a heater and filling ports with respect to an internal space.

As shown in FIG. 5, the internal space 90 has an extending region 95 that is located at the center along the center line O direction (the vertical direction) and a supporting region 93 and a supporting region 94 that are located in a line so as to sandwich the extending region 95. The heater 10 is accommodated from the supporting region 93 to the extending region 95 and the supporting region 94.

The end portion 13 and a connecting portion 15*a* of the heater 10 are accommodated in one supporting region 93. The connecting portion 15*a* is a part of the extending portion 15 connected to the end portion 13.

A central portion 15*c* of the extending portion 15 of the heater 10 is accommodated in the center extending region 95.

The end portion 14 and a connecting portion 15*b* of the heater 10 are accommodated in other supporting region 94. The connecting portion 15*b* is a part of the extending portion 15 connected to the end portion 14.

The wall portion 35 and the filling ports 43 and 44 form a weir that guides the molten metal, which has been injected into the internal space 90, to predetermined positions.

The filling ports 43 and 44 are formed to have a slit shape having a substantially rectangular channel cross-sectional shape. In the filling ports 43 and 44, the opening width in the center line O direction is larger than the opening width in the direction perpendicular to the center line O.

The one filling port 43 opens to the portion of the side end surface 35*a* facing the supporting region 93. The filling port 43 is formed at a position in which its channel center line extends substantially in parallel with the end portion 13 of the heater 10 with a space therebetween.

The filling port 43 is formed so as to face the connecting portion 15*a* of the extending portion 15 in the vicinity of the end portion 13 and to face a position offset with respect to the supporting portion 33. As shown in FIG. 3, the filling port 43 faces the center portion of the connecting portion 15*a* including the center line O.

With such a configuration, the molten metal injected from the filling port 43 flows along the end portion 13 of the heater 10 and flows into the central part of the supporting region 93.

Another filling port 44 opens to the portion of the side end surface 35*a* facing the supporting region 94. The filling port 44 is formed at a position in which its channel center line extends substantially in parallel with the end portion 14 of the heater 10 with a space therebetween.

The filling port 44 is formed so as to face the connecting portion 15*b* of the extending portion 15 in the vicinity of the end portion 14 and to face a position offset with respect to the supporting portion 34. The filling port 44 faces the center portion of the connecting portion 15*h* including the center line O.

With such a configuration, the molten metal injected from the filling port 44 flows along the end portion 14 of the heater 10 and flows into the central part of the supporting region 94.

Thus, the molten metal is smoothly filled into the internal space 90 from the filling ports 43 and 44, and thereby, the formation of the cavity in the cast part 70 is prevented.

As described above, according to the present embodiment, there is provided the casting mold 30 provided with the filling ports 43 and 44 through which the molten metal is filled into the internal space 90 in which the heater 10 (the structure) is installed. The filling ports 43 and 44 respectively open to the portions of the molding wall portion 32 facing the supporting regions 93 and 94.

With such a configuration, when the molten metal is filled as described above, the molten metal in the form of a spray flows into the supporting regions 93 and 94 in the internal space 90 from the filling ports 43 and 44, and the molten metal hits the end portions 13 and 14 and the connecting portions 15*a* and 15*b* of the heater 10 at a speed of, for example, about 50 m/s. In the heater 10, because the distance from the supporting portions 33 and 34 to the end portions 13 and 14 and the connecting portions 15*a* and 15*b* where the molten metal flow hits is short, a sufficient strength against the load applied by the molten metal flow is ensured.

On the other hand, in the extending region 95 in the internal space 90, the molten metal flow injected from the filling ports 43 and 44 is guided around the extending portion 15 through the supporting regions 93 and 94.

Because the distance from the central portion 15*c* of the extending portion 15 to the supporting portions 33 and 34 is longer than the distances from the connecting portions 15*a* and 15*b* to the supporting portions 33 and 34, if the high-speed molten metal flow injected from the filling ports 43 and 44 hits the central portion 15*c*, the central portion 15*c* may be deformed due to the load applied by the molten metal flow.

As a countermeasure against such a problem, the filling ports 43 and 44 respectively open to the portions of the molding wall portion 32 facing the supporting regions 93 and 94. With such a configuration, the high-speed molten metal flow injected into the internal space 90 from the filling ports 43 and 44 is decelerated through the supporting regions 93 and 94 and hits the central portion 15*c* at a speed of, for example, about 5 m/s. Therefore, in the heater 10, the sufficient strength against the load applied by the molten metal flow is ensured for the central portion 15*c* of the extending portion 15. Thus, the deformation of the heater 10 due to the load applied by the molten metal flow is prevented.

In addition, according to the present embodiment, the casting mold 30 is provided with the plurality of supporting portions 33 and 34. The heater 10 is provided with the extending portion 15 that is provided so as to extend between the plurality of end portions 13 and 14.

By being configured as described above, the extending portion 15 of the heater 10 is supported by the plurality of end portions 13 and 14 at the both ends, and so, bending stress caused by the molten metal flow is suppressed to the minimum. Thus, it is possible to effectively prevent the deformation of the heater 10.

Thus, according to the present embodiment, it is possible to provide the manufacturing method of the cast part 70 for manufacturing the cast part 70 into which the heater 10 is cast using the casting mold 30.

In addition, according to the present embodiment, it is possible to provide the manufacturing method of the cast part 70 for manufacturing the cast part 70 into which the spiral metal pipe 10*a* is cast as the structure installed in the internal space 90.

By being configured as described above, in the heater unit, the shape of the spiral metal pipe 10*a* prone to be deformed is maintained, and the desired performance can be obtained.

Figure 6:
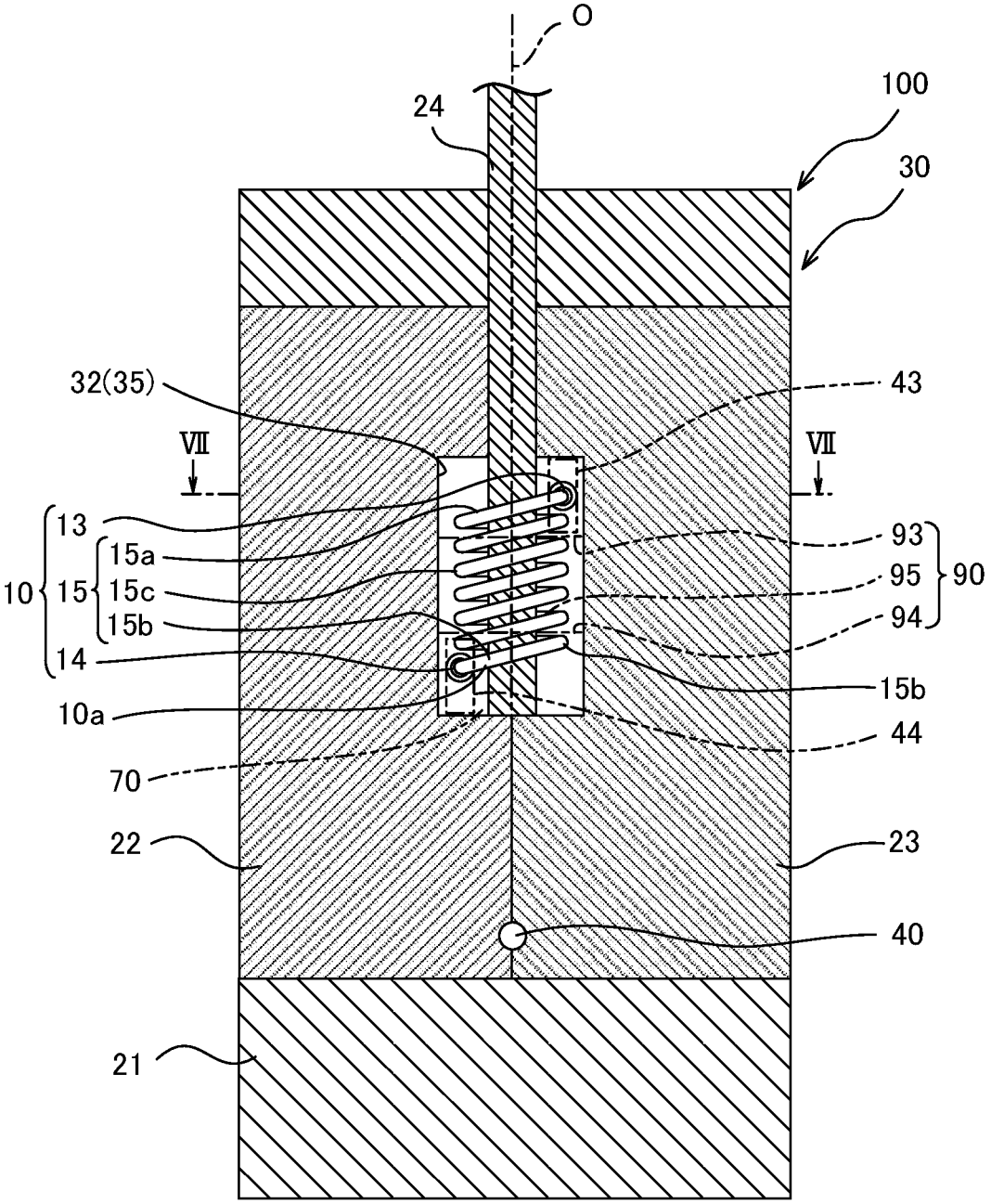
FIG. 6 is a longitudinal cross-sectional view showing a modification of the casting mold.
Figure 7:
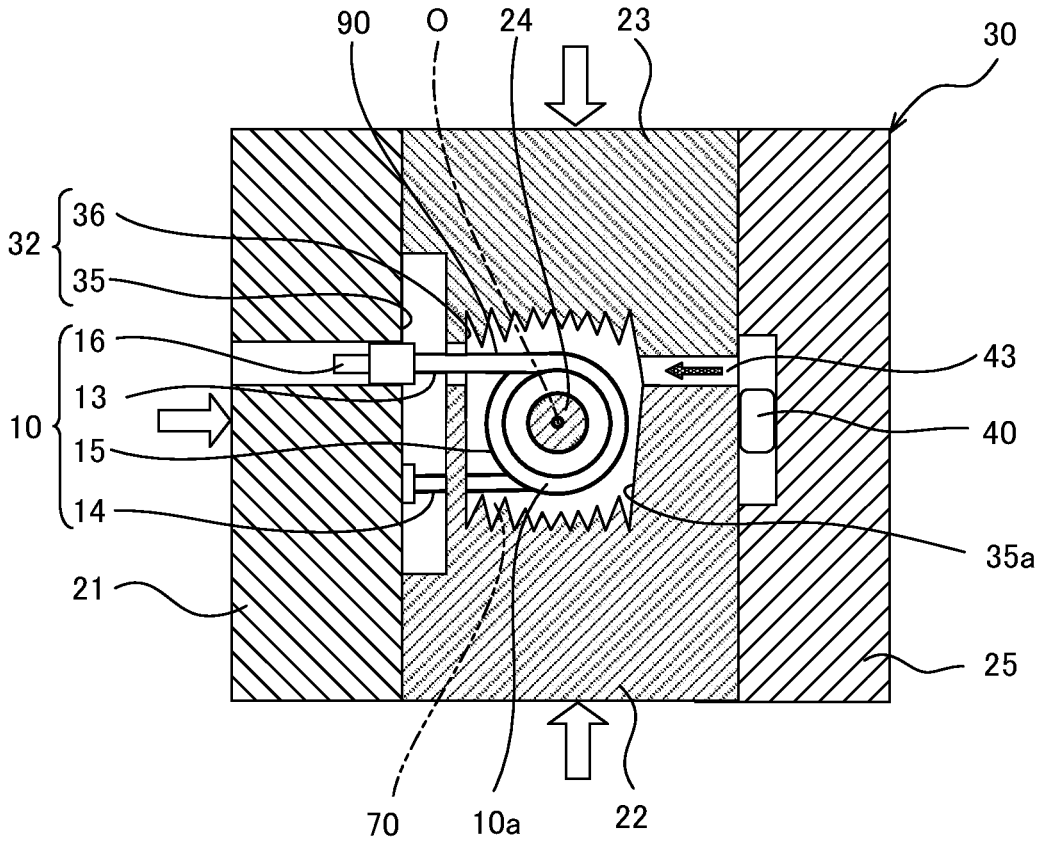
FIG. 7 is a lateral cross-sectional view taken along a line VII-VII in FIG. 6.
Figure 8:
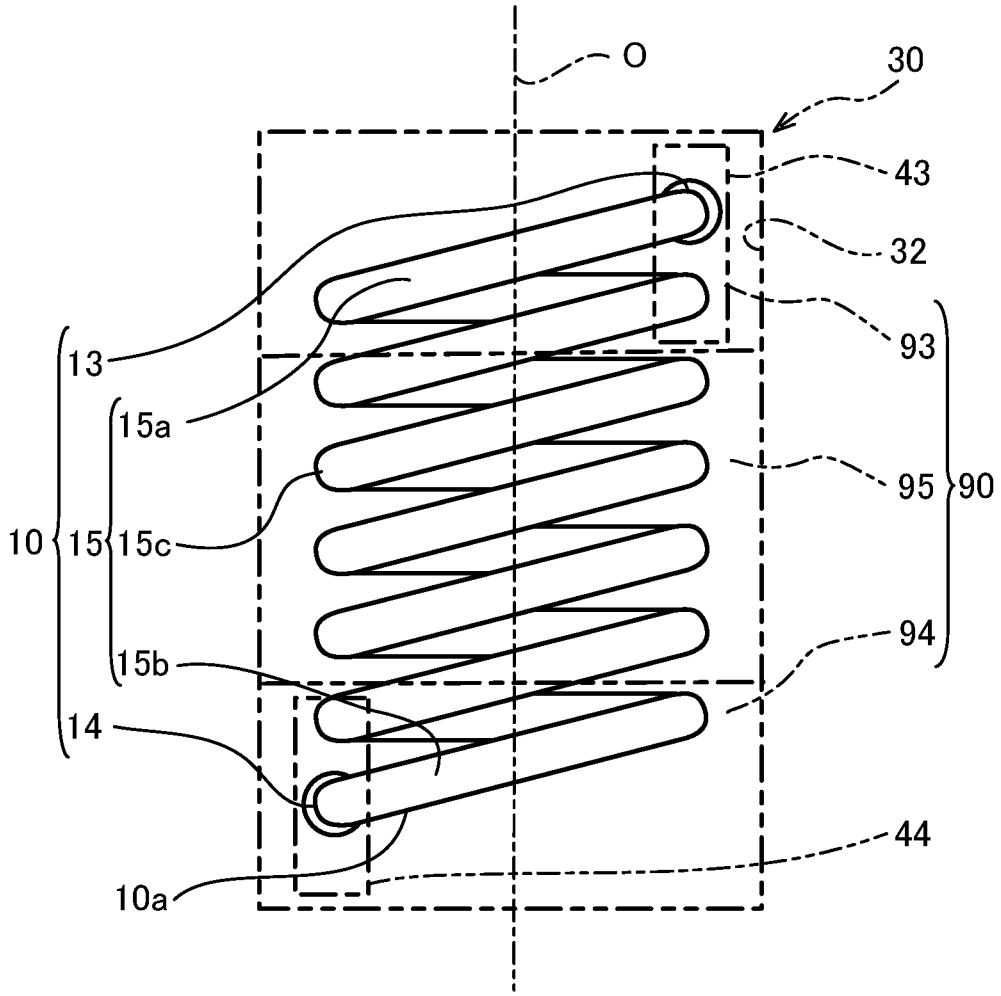
FIG. 8 is a diagram showing the arrangement of the heater and the filling ports with respect to the internal space.

Next, a modification of the casting mold 30 shown in FIGS. 6 to 8 will be described.

The slit shaped filling ports 43 and 44 are respectively formed at positions facing the supporting portions 33 and 34 via the supporting regions 93 and 94. The filling ports 43 and 44 are formed so as to respectively face the vicinities of two opposing corner portions in the internal space 90.

The one filling port 43 opens to the portion of the side end surface 35*a* facing the supporting region 93 and is formed at the position so as to extend on the extending line of the end portion 13 of the heater 10.

With such a configuration, the molten metal injected from the filling port 43 flows along the end portion 13 of the heater 10 and flows into the vicinities of the corner portions in the supporting region 93.

The another filling port 44 opens to the portion of the side end surface 35*a* facing the supporting region 94 and is formed at the position so as to extend on the extending line of the end portion 14 of the heater 10.

With such a configuration, the molten metal injected from the filling port 44 flows along the end portion 14 of the heater 10 and flows into the vicinities of the corner portions in the supporting region 93.

By being configured as described above, the molten metal flowing into the supporting regions 93 and 94 from the filling ports 43 and 44 flows along the end portions 13 and 14 of the heater 10 projecting out from the supporting portions 33 and 34. With such a configuration, bending load exerted by the molten metal flow to the end portions 13 and 14 is suppressed to the minimum. Thus, it is possible to effectively prevent the deformation of the heater 10.

Embodiments of the present invention were described above, the above embodiments are merely examples of applications of this invention, and the technical scope of this invention is not limited to the specific constitutions of the above embodiments.

Although the present invention is suitable as the casting mold for casting the heater, it may also be applicable to the casting mold for casting the structure other than the heater.

Although the present invention is suitable as the casting method by the die casting method in which the molten metal is pressurized and filled into the casting mold, it may also be applicable to other casting methods.

The invention claimed is:

1. A heater unit casting mold for molding a cast part becoming the heater unit by filling molten metal into an internal space in which a heater is installed, the heater unit casting mold comprising:

a molding wall portion configured to form the internal space;

a supporting portion configured to support the heater to the molding wall portion; and a filling port configured to allow the molten metal to flow into the internal space, wherein the heater has:

a fixed portion configured to be supported by the supporting portion; and an extending portion configured to be extended from the fixed portion, the internal space has:

a supporting region configured to accommodate the fixed portion; and an extending region configured to accommodate the extending portion, the supporting region and the extending region are arranged so as to be aligned in a direction perpendicular to a flowing direction of the molten metal, and the filling port opens only to a portion of the molding wall portion facing the supporting region.

2. The casting mold according to claim 1, further comprising a plurality of the supporting portions, wherein the heater is provided with the extending portion extending over a plurality of the fixed portions.

3. The casting mold according to claim 1, wherein the filling port is formed at a position facing the supporting portion.

4. The heater unit casting mold according to claim 1, wherein the extending portion is a spiral metal pipe.

5. A manufacturing method of a heater unit for molding a cast part becoming the heater unit by filling molten metal into an internal space of a casting mold in which a heater is installed, wherein the casting mold is provided with:

a molding wall portion configured to form the internal space;

a supporting portion configured to support the heater to the molding wall portion; and a filling port configured to allow the molten metal to flow into the internal space, the heater has:

a fixed portion configured to be supported by the casting mold; and an extending portion configured to be extended from the fixed portion, the internal space has:

a supporting region configured to accommodate the fixed portion; and an extending region configured to accommodate the extending portion, the supporting region and the extending region are arranged so as to be aligned in a direction perpendicular to a flowing direction of the molten metal, and the manufacturing method comprising:

an installation process of installing the heater in the casting mold; and a filling step of allowing the molten metal to flow into the internal space through the filling port, the filling port being configured to open to a portion of the molding wall portion facing the supporting region.

6. The manufacturing method of the heater unit according to claim 5, wherein a spiral metal pipe is cast as the heater.

* * * * *